US012559960B1

(12) United States Patent
Medina

(10) Patent No.: US 12,559,960 B1
(45) Date of Patent: Feb. 24, 2026

(54) COVER SECURING SYSTEM FOR COVER ON ABOVE-GROUND POOL AND METHOD OF USE

(71) Applicant: Daniel Medina, Lowell, IN (US)

(72) Inventor: Daniel Medina, Lowell, IN (US)

( * ) Notice: Subject to any disclaimer, the term of this patent is extended or adjusted under 35 U.S.C. 154(b) by 140 days.

(21) Appl. No.: 18/219,503

(22) Filed: Jul. 7, 2023

Related U.S. Application Data

(60) Provisional application No. 63/359,053, filed on Jul. 7, 2022.

(51) Int. Cl.
*E04H 4/10* (2006.01)

(52) U.S. Cl.
CPC ..... *E04H 4/106* (2013.01)

(58) Field of Classification Search
CPC ..... E04H 4/106
USPC ..... 4/498, 494–496; 126/171; 135/87; 220/216
See application file for complete search history.

(56) References Cited

U.S. PATENT DOCUMENTS 3,077,610 A * 2/1963 Gazdik ..... E04H 4/10 4/503
3,391,410 A * 7/1968 Melberg ..... E04H 4/10 292/256.65
3,523,308 A * 8/1970 Bradley ..... E04H 4/10 4/503
3,528,110 A * 9/1970 Woycik ..... E04H 4/10 4/503
3,683,427 A * 8/1972 Burkholz ..... E04H 4/108 52/80.1
3,707,007 A * 12/1972 Trostler ..... E04H 4/10 4/500
3,711,873 A * 1/1973 Katzman ..... E04H 4/10 4/503
3,732,581 A * 5/1973 Pitti ..... E04H 4/10 4/503
3,747,131 A * 7/1973 Koliomichalis ..... E04H 4/103 4/503
3,780,385 A * 12/1973 Dunn ..... E04H 4/065 4/501
4,000,527 A * 1/1977 Gannon ..... E04H 4/106 4/499
4,000,749 A * 1/1977 Busco ..... A61G 10/005 135/117
4,011,607 A * 3/1977 Davidoff ..... E04H 4/10 4/503
4,078,293 A * 3/1978 Aine ..... E04H 4/084 264/45.2
4,122,562 A * 10/1978 Sorrentino ..... E04H 4/106 4/498

(Continued)

FOREIGN PATENT DOCUMENTS

AU 2013100401 B4 5/2013
CA 2614799 A1 * 6/2009 ..... E04H 4/0025

(Continued)

*Primary Examiner* — Lori L Baker
(74) *Attorney, Agent, or Firm* — John Rizvi; John Rizvi, P.A.—The Patent Professor®

(57) ABSTRACT

A cover securing system for a pool cover on an above-ground pool comprises a peripheral fasteners and a weigh down apparatus; wherein the peripheral fasteners is configured to engage a periphery of the pool cover with a top rail of the above-ground pool.

20 Claims, 4 Drawing Sheets

(56) References Cited

U.S. PATENT DOCUMENTS 4,158,244 A * 6/1979 Stefan ..... E04H 4/142 248/273
4,251,889 A * 2/1981 Lof ..... E04H 4/10 4/503
4,285,078 A * 8/1981 Batstone ..... E04H 4/065 4/488
4,393,528 A * 7/1983 West ..... E04H 4/084 4/498
4,535,490 A * 8/1985 Wright ..... A47K 3/06 4/584
4,537,147 A * 8/1985 Nivin ..... B63B 19/14 114/201 R
4,601,072 A * 7/1986 Aine ..... E04H 4/08 4/493
4,847,925 A * 7/1989 Perry ..... E04H 4/106 4/503
5,068,929 A * 12/1991 Weiner ..... E04H 4/10 160/368.1
5,095,557 A * 3/1992 Keyes ..... E04H 4/10 4/503
5,551,099 A * 9/1996 Kirk ..... E04H 4/10 4/503
5,826,283 A * 10/1998 Edwards ..... E04H 4/10 4/503
7,322,309 B2 * 1/2008 Larochelle ..... B63B 7/08 114/345
7,712,160 B2 * 5/2010 Pesta ..... E04H 4/10 4/498
7,871,052 B2 * 1/2011 Baum ..... E04H 4/10 248/500
7,874,023 B1 * 1/2011 Sundling ..... E04H 4/105 4/503
8,205,393 B1 * 6/2012 Harrop ..... B09B 1/004 405/129.9
8,226,150 B1 * 7/2012 Schmeichel ..... B60J 7/085 296/100.15
8,777,516 B2 * 7/2014 Slutz ..... B09B 1/004 160/264
9,309,684 B2 * 4/2016 Richards ..... E04H 4/10
9,644,391 B1 * 5/2017 Urhausen ..... E04H 15/62
10,392,185 B2 * 8/2019 Tschatschula ..... B65B 7/28
D877,275 S * 3/2020 Wagner ..... D21/839
10,876,309 B2 * 12/2020 Lewis ..... E04H 4/10
10,966,372 B1 * 4/2021 Anspach ..... B65B 27/125
D973,214 S * 12/2022 MacKay ..... D24/204
11,970,050 B2 * 4/2024 Huening ..... B32B 3/08
12,004,454 B2 * 6/2024 Davis ..... A01F 25/13
D1,049,425 S * 10/2024 Weiss ..... E04H 4/10 D25/2
2002/0108170 A1 * 8/2002 Minnick ..... E04H 4/08 4/498
2004/0194393 A1 * 10/2004 Horman ..... E04B 1/66 52/3
2006/0150537 A1 * 7/2006 Baum ..... E04G 21/28 52/90.1
2007/0232163 A1 * 10/2007 Larochelle ..... B63B 7/08 441/40
2009/0235496 A1 * 9/2009 Baum ..... E04G 21/28 24/458
2013/0139312 A1 * 6/2013 Richards ..... E04H 4/106 4/498
2015/0224911 A1 * 8/2015 Schmeichel ..... B60J 7/085 296/98

FOREIGN PATENT DOCUMENTS

CA 2680983 A1 * 4/2010 ..... E04H 4/103
EP 2017406 A1 * 1/2009 ..... E04H 4/106
WO WO-2004096375 A1 * 11/2004 ..... A63B 5/11

* cited by examiner

COVER SECURING SYSTEM FOR COVER ON ABOVE-GROUND POOL AND METHOD OF USE

CROSS-REFERENCE TO RELATED APPLICATION

This application claims the benefit of U.S. Provisional Patent Application No. 63/359,053, filed on Jul. 7, 2022, which is incorporated herein by reference in its entirety.

FIELD OF THE INVENTION

The present invention relates to a cover securing system for a pool cover on an above-ground pool and an above-ground pool construction having an above-ground pool, a pool cover and a cover securing system.

BACKGROUND OF THE INVENTION

A swimming pool, swimming bath, wading pool, paddling pool, or simply pool, is a structure designed to hold water to enable swimming or other leisure activities. Pools can be built into the ground (in-ground pools) or built above ground (as a freestanding construction or as part of a building or other larger structure), and may be found as a feature aboard ocean-liners and cruise ships. In-ground pools are most commonly constructed from materials such as concrete, natural stone, metal, plastic, or fiberglass, and can be of a custom size and shape or built to a standardized size, the largest of which is the Olympic-size swimming pool.

Many health clubs, fitness centers, and private clubs have pools used mostly for exercise or recreation. It is common for municipalities of every size to provide pools for public use. Many of these municipal pools are outdoor pools but indoor pools can also be found in buildings such as natatoriums and leisure centers. Hotels may have pools available for their guests to use at their own leisure. Pools as a feature in hotels are more common in tourist areas or near convention centers. Educational facilities such as high schools and universities sometimes have pools for physical education classes, recreational activities, leisure, and competitive athletics such as swimming teams. Hot tubs and spas are pools filled with water that is heated and then used for relaxation or hydrotherapy. Specially designed swimming pools are also used for diving, water sports, and physical therapy, as well as for the training of lifeguards and astronauts. Swimming pools most commonly use chlorinated water or salt water and may be heated or unheated.

Pools can be either indoors or outdoors. They can be of any size and shape, and inground or above ground. Most pools are permanent fixtures, while others are temporary, collapsible structures.

Private pools are usually smaller than public pools. Home pools can be permanently built-in, or be assembled above ground and disassembled after summer. Privately owned outdoor pools in backyards or gardens started to proliferate in regions with warm summer climates, and where the temperatures are mild in the winter months.

Construction methods for private pools vary greatly. The main types of in-ground pools are gunite shotcrete, concrete, vinyl-lined, and one-piece fiberglass shells.

Many countries now have strict pool fencing requirements for private swimming pools, which require pool areas to be isolated so that unauthorized young children cannot enter. Many countries require a similar level of protection for the children residing in or visiting the house, although many pool owners prefer the visual aspect of the pool in close proximity to their living areas and will not provide this level of protection. The rules and requirements related to pool fencing vary from state to state and even county to count, and in many places they are not required at all, particularly in rural settings.

Swimming pool heating costs can be significantly reduced by using a pool cover. Use of a pool cover also can help reduce the amount of chemicals (chlorine, etc.) required by the pool. Outdoor pools gain heat from the sun, absorbing 75-85% of the solar energy striking the pool surface. Though a cover decreases the total amount of solar heat absorbed by the pool, the cover eliminates heat loss due to evaporation and reduces heat loss at night through its insulating properties, Most swimming pool heat loss is through evaporation.

The heating effectiveness of a cover depends on type. A transparent bubble cover is the most effective, as it allows the largest amount of solar flux into the pool itself. Thermal bubble covers are lightweight UV-stabilized floating covers designed to minimize heat loss on heated swimming pools. Typically they are only fitted in spring and fall (autumn) when the temperature difference between pool water and air temperature is greatest. When used consistently they can raise average pool temperatures of an outdoor pool by around 18° Fahrenheit (11° Celsius) when combined with a well sized solar pool heating system, or about 11° Fahrenheit (6° Celsius) without a solar heater but with full sun exposure. Covers fall apart after four or five years due to sun exposure, overheating in the sun while off the pool, and chlorine attacking the plastic. Bubble covers should be removed during super chlorination.

A vinyl cover absorbs more sunlight directly, allowing temperature to rise faster, but ultimately prevents the pool from reaching as high a temperature as a clear cover. Vinyl covers consist of a heavier material and have a longer life expectancy than bubble covers. Insulated vinyl covers are also available with a thin layer of flexible insulation sandwiched between two layers of vinyl. This is an effort to conserve water, as much water evaporates and transpires.

An alternative to a continuous sheet of pool covering is multiple floating disks which are deployed and removed disk by disk. They cover most of the surface of the pool and offer evaporation reduction similar to continuous covers. Various types are available, for example opaque (for UV resistance and possible reduced algal growth), transparent (for esthetics), heavy and solid (for wind resistance), light and inflatable (for ease of handling).

In areas which reach freezing temperature, it is important to close a pool properly. This varies greatly between in-ground and above-ground pools. By taking steps to properly secure the pool, it lessens the likelihood that the superstructure will be damaged or compromised by freezing water.

In preparation for freezing temperatures, an in-ground swimming pool's pipes must be emptied. An above-ground pool should also be closed, so that ice does not drag down the pool wall, collapsing its structure. The plumbing is sealed with air, typically with rubber plugs, to prevent cracking from freezing water. The pool is typically covered to prevent leaves and other debris from falling in. The cover is attached to the pool typically using a stretch cord, similar to a bungee cord, and hooks fitted into the pool surround. Floating objects such as life rings or basketballs can be placed in the pool to avoid its freezing under the cover. Sand or DE filters must be backwashed, with the main drain plug removed and all water drained out. Drain plugs on the pool filter are removed after the filter has been cleaned. The pool pump motor is taken under cover. Winter chemicals are added to keep the pool clean. The innovation of a composite construction of fiberglass, with an epoxy coating and porcelain ceramic tiles has led to the pre-form, composite-type with significant advantages over older methods; however, it also has increased sensitivity to metal staining.

Above-ground pools are installed at ground level, so the entire pool extends above the ground. Unlike in-ground pools and semi-in-ground pools, these pools don't require heavy equipment or a permanent installation. Most above-ground pools come as a kit, with a steel or aluminum wall, a resin or fiberglass post system, and a vinyl liner. Above-ground pools are popular because they are much more affordable than alternatives. These pools can also be relocated, and if you ever choose to remove the pool, it's a much easier process.

It may be impractical to take down an above-ground pool and put it back up during the cooler months or when it is not used, though, a cover may be needed on it. Above-ground pool covers are similar to in-ground covers in a number of ways, and it's important to cover both types of pools for several different reasons. If an above-ground pool is not covered, it's going to get dirt, leaves, and other debris in it. Also, the Wind will still blow debris into the water. Not to mention rainwater! The pool will quickly become very dirty, and it may even be unsafe to swim in if it is uncovered for more than a day or two. It also makes it much easier to keep a pool clean since the pool cover will catch all this debris. What has to be done is to sweep off the cover or, to turn it upside down and shake the dirt off. Leaving the pool open can be unsafe for a number of reasons. If the pool area needs to be kept safe, it has to be covered when not in use. Solar covers reduce the amount of water that evaporates from the pool. This, in turn, reduces the number of chemicals that evaporate. With a solar cover, the pool doesn't have to be refilled as often or put as many chemicals in it. These covers also trap solar heat in their bubbles and pass that heat down into the water, heating it. It won't have to use as much power running pool heaters if one of these covers is used. When the summer is over and the pool won't be used for a number of months, it should be winterized. This involves cleaning the pool and adding special chemicals to help it remain clean during the winter. It also needs to cover the poor to help reduce damage and water contamination while it's not in use. Without a cover, a number of different issues are invited, including damage to the pool that can be bad enough to make it unusable.

Using a pool cover in an area where the winds and other elements are strong is challenging. The pool's cover is there to protect the pool. The cover must be protected by securing it properly on the pool. To secure a pool cover on an above-ground pool, make sure the cable and winch attached to the pool cover is secure and tight. A faulty cable and winch can break and release. However, when a cover is put on the above-ground pool, the wind can then easily blow the cover off.

Accordingly, there is need for a solution to at least one of the aforementioned problems.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

The present invention is directed to a cover securing system for a pool cover on an above-ground pool, where the cover securing system may comprising a plurality of peripheral fasteners, where the plurality of peripheral fasteners attach a peripheral edge of the pool cover to a rim of the above-ground pool; a weigh down apparatus positioned atop a top surface of the pool cover, wherein the weigh down apparatus incudes: an inflatable tube, where the inflatable tube is comprised of a pair of tubular members extending from a U-shaped middle portion to create an M-shape of the weigh inflatable tube; wherein the M-shape anchors the inflatable tube against the pool cover; and an inflation means removably coupled to the weigh down apparatus, where the inflation means inflates the weighted tube and further anchors the weigh down apparatus atop the pool cover.

In another aspect of the invention, the weigh down apparatus may include a pair of junctions where the pair of tubular members meet the U-shaped center portion, where the pair of junctions may further define the M-shape of the inflatable tube.

In another aspect of the invention, the pair of junctions may be rigid.

In another aspect of the invention, the pair of junctions may be flexible.

In another aspect of the invention, the plurality of peripheral fasteners may be clips.

In another aspect of the invention, the plurality of peripheral fasteners may be clamps.

In another aspect of the invention, the inflatable tube may be weighted.

In another aspect of the invention, at least one of the tubular members may include an inlet, where the inlet may allow the inflation means to inflate the weigh down apparatus.

In another aspect of the invention, thee inlet may further include a stopper to prevent deflation during use.

In another aspect of the invention, the inflation means may include a hose and a compressor to facilitate inflating the weigh down apparatus with a gaseous substance.

In another aspect of the invention, the gaseous substance may be compressed air.

In another aspect of the invention, the pool cover may be made from a flexible, waterproof material.

In another aspect of the invention, the flexible waterproof material may be one of at least plastic, polyethylene, or canvas.

In another aspect of the invention, the pair of tubular members may be curved to compliment the rim of a circular above ground pool.

In another aspect of the invention, the pair of tubular members may be straight to compliment the rim of a rectangular above ground pool.

The present invention may be directed to a method of use for a cover securing system to anchor a pool cover atop an above ground pool, where the system may comprise the steps of positioning a pool cover over the above ground pool, where the pool cover rests atop a water surface of the above ground pool; positioning a weigh down apparatus on a top surface of the pool cover, where the weigh down apparatus includes a weighted inflatable tube, where the weighted inflatable tube consists of a pair of tubular members extending from a U-shaped center portion; inflating the weighted inflatable tube of the weigh down apparatus; and attaching a plurality of peripheral fasteners to a peripheral edge of the pool cover, where the plurality of peripheral fasteners couple the pool cover to the rim of the above ground pool.

In another aspect of the method, the system may further include attaching a hose to at least one of the tubular members, where the hose enables inflation of the weighted inflatable tube via a compressor.

In another aspect of the method, the system may further include removing a stopper from an inlet on one of the tubular members to inflate the weighted inflatable tube.

In another aspect of the method, the system may further include adjusting the pair of tubular members against the rim to prevent air from lifting the pool cover from the water surface.

The present invention may be directed to a cover securing system for a pool cover of an above ground pool which may comprise a plurality of peripheral fasteners, where the plurality of peripheral fasteners attach a peripheral edge of the pool cover to a rim of the above-ground pool; a weigh down apparatus positioned atop a top surface of the pool cover, wherein the weigh down apparatus incudes: a weighted inflatable tube, where the weighted inflatable tube is comprised of a pair of tubular members extending from a middle portion to create a shape; wherein the shape anchors the weighted inflatable tube against the pool cover; and an inflation means removably coupled to the weigh down apparatus, where the inflation means inflates the weighted tube and further anchors the weigh down apparatus atop the pool cover.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

These and other objects, features, and advantages of the present invention will become more readily apparent from the attached drawings and the detailed description of the preferred embodiments, which follow.

BRIEF DESCRIPTION OF THE DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

The preferred embodiments of the invention will hereinafter be described in conjunction with the appended drawings provided to illustrate and not to limit the invention, where like designations denote like elements, and in which:

Figure 1:
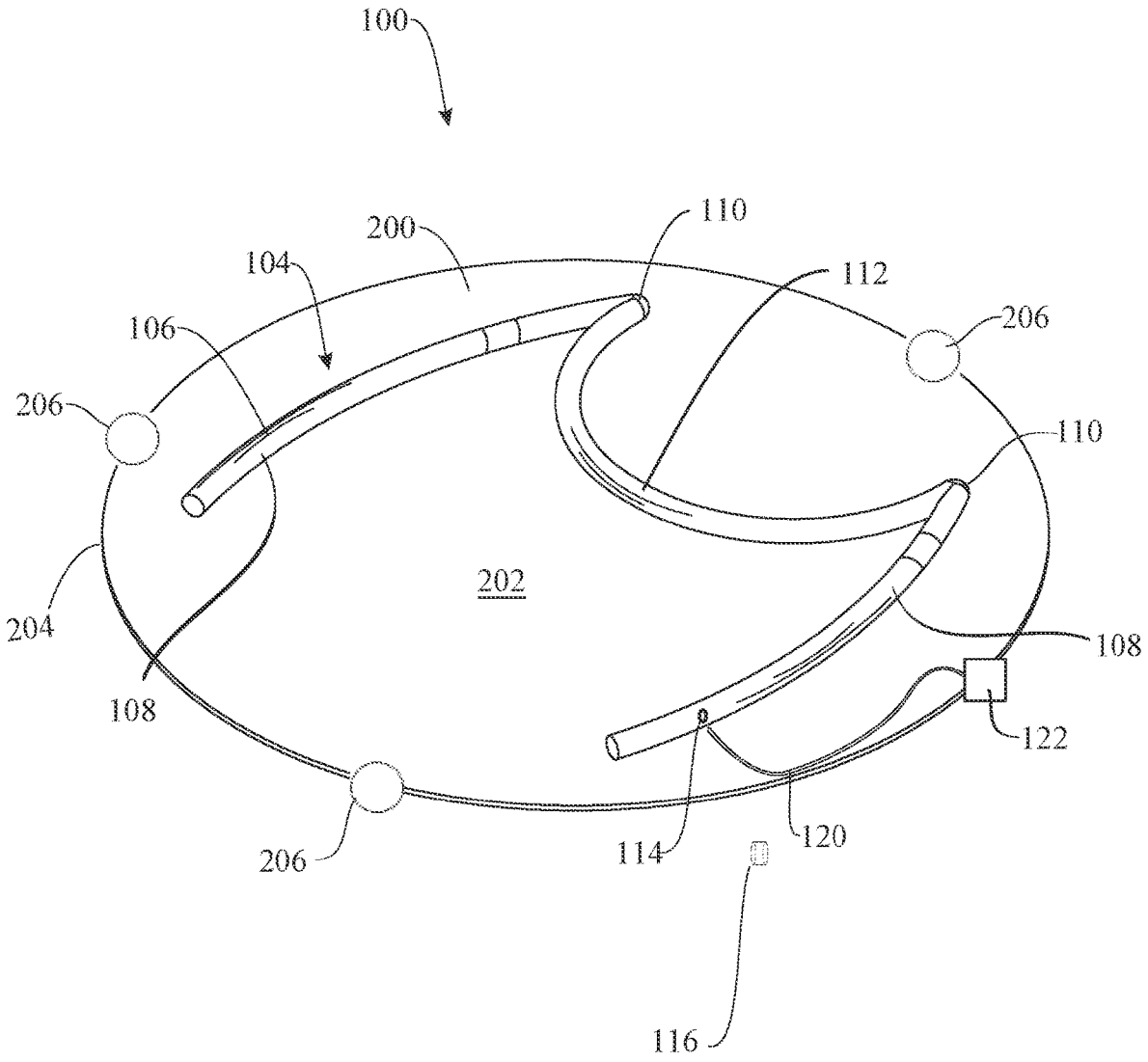
Figure 2:
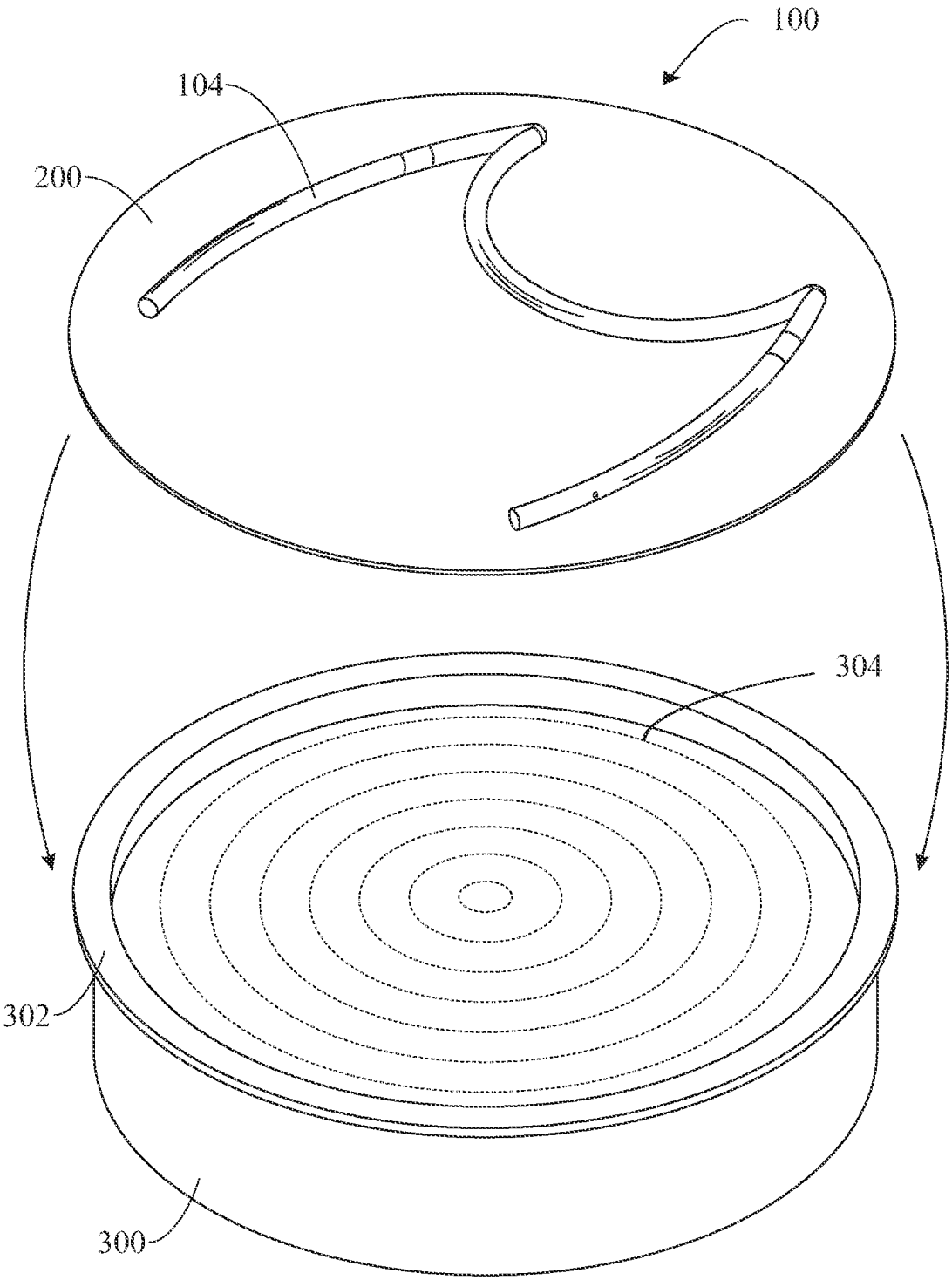
Figure 3:
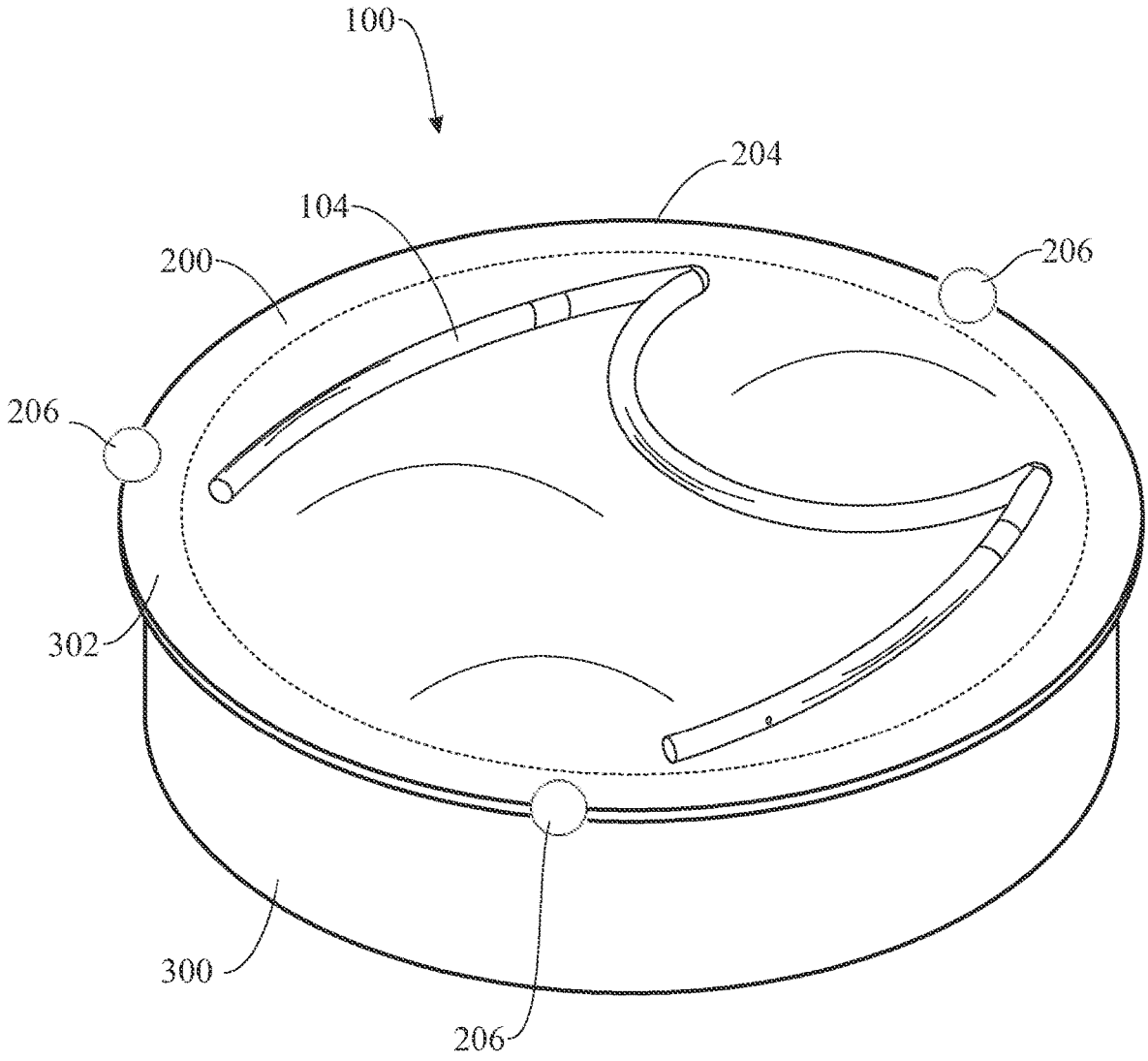
Figure 4:
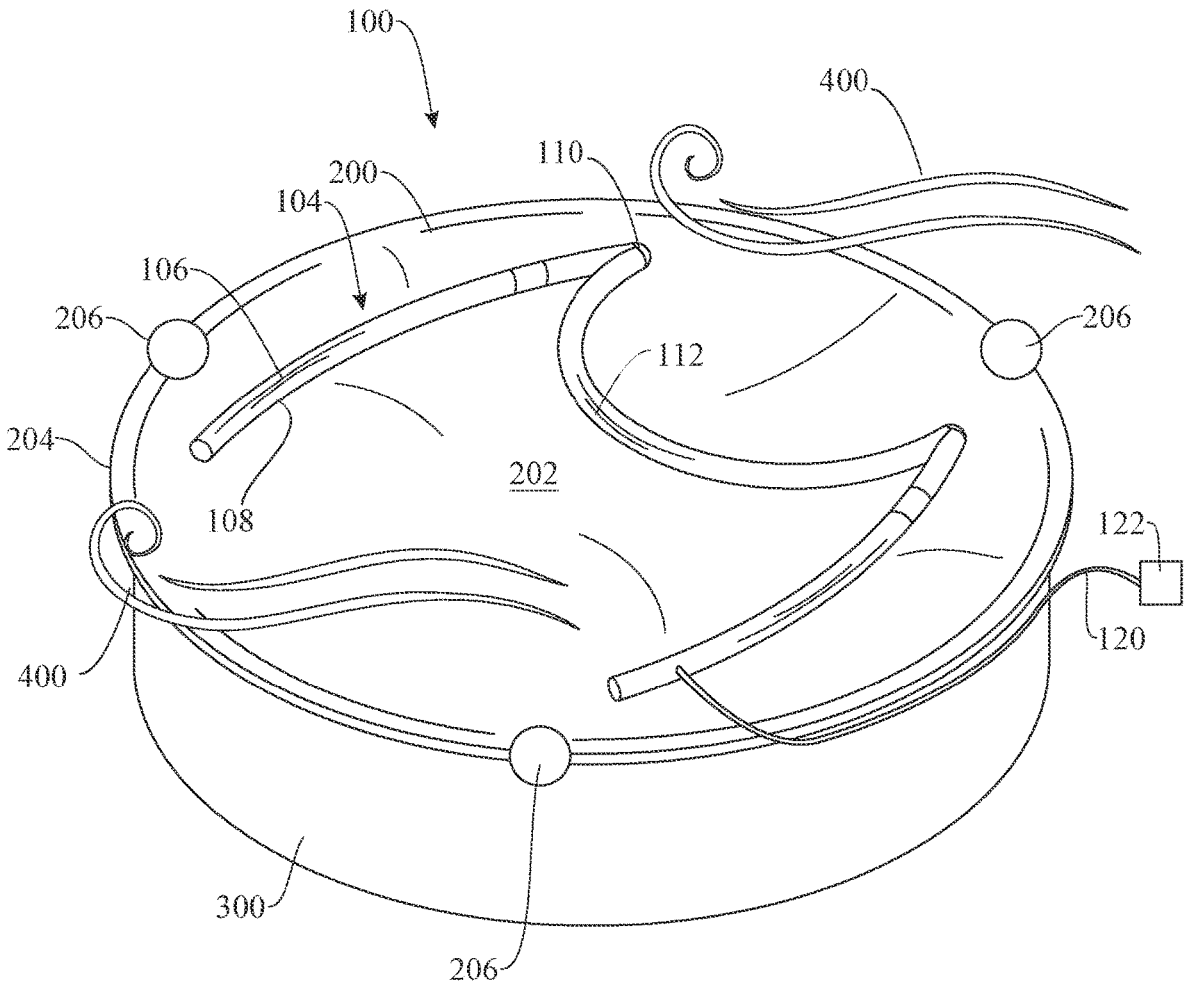

FIG. 1 presents a perspective view a cover securing system in accordance with the present invention;

FIG. 2 presents a separated view of a cover securing system for covering an above-ground pool with a pool cover elevated above an above ground pool according to the present invention;

FIG. 3 presents a perspective view of a cover securing system positioned over an above-ground pool according to an embodiment of the present invention; and FIG. 4 presents a perspective view of a cover securing system positioned on an above ground pool during use according to the present invention Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the appended claims. The present disclosure contains headers. It should be understood that these headers are used as references and are not to be construed as limiting upon the subjected matter disclosed under the header.

Other technical advantages may become readily apparent to one of ordinary skill in the art after review of the following figures and description. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Unless otherwise indicated, the drawings are intended to be read together with the specification and are to be considered a portion of the entire written description of this invention. As used in the following description, the terms "horizontal", "vertical", "left", "right", "up", "down" and the like, as well as adjectival and adverbial derivatives thereof (e.g., "horizontally", "rightwardly", "upwardly", "radially", etc.), simply refer to the orientation of the illustrated structure as the particular drawing figure faces the reader. Similarly, the terms "inwardly," "outwardly" and "radially" generally refer to the orientation of a surface relative to its axis of elongation, or axis of rotation, as appropriate.

Shown throughout the figures, the present invention is directed toward a cover securing system 100 for a pool cover 200 on a pool 300.

Referring to FIG. 1, a perspective view of a cover securing system 100 is shown in accordance with the present embodiment of the present invention. In an embodiment of the present invention, the cover securing system 100 may consist of a pool cover 200 and a weigh down apparatus 104.

The pool cover 200 may have a top surface 202, a bottom surface (not shown), and a peripheral edge 204. The pool cover 200 may be substantially circular in shape. Alternatively, the pool cover 200 may be rectangular or squared, or any coordinating shape to completely cover the size of the above ground pool that will be covered. The pool cover 200 may be made from a flexible, waterproof fabric or material like plastic, polyethylene, canvas, or other suitable materials.

Around the peripheral edge 204 of the pool cover 200 may be a plurality of peripheral fasteners 206. The plurality of peripheral fasteners 206 may anchor the peripheral edge 204 of the pool cover 200 to an edge of the above ground pool (further explained below).

The cover securing system 100 may comprise a weigh down apparatus 104, where the weigh down apparatus 104 may be configured to be coupled to the top surface 202 of the pool cover 200. The weight down apparatus 104 may weigh down or anchor the pool cover 200 atop the water surface of the above ground pool, thereby preventing the wind or drafts from lifting or blowing the pool cover 200 from where it is placed.

The weigh down apparatus 104 may include an inflatable weighted tube 106. The inflatable weighted tube 106 may consist of a pair tubular members 108 that may extend from a Ui-shaped center portion 112. The U-shaped center portion 112 may meet the pair of tubular members 108 at a pair of junctions 110 at each lateral end of the U-shaped center portion 112. The pair of junctions 110 may be rigid to support the shape of the inflatable weighted tube 106. Alternatively, the pair of junctions 110 may be flexible for fluctuation in sizing, shape and orientation of the inflatable weighted tube 106. With flexible junctions 110 the pair of tubular members 108 may be adjusted so they are directly positioned proximal to the rim of the pool.

Along one of the tubular members 108 may be an inlet 114. The inlet 114 may include a stopper or plug 116 to open and close the inlet 114 as needed. Coordinating with the inlet 114, the cover securing system 100 may include a hose 120 and an air compressor 122. The hose 120 may attach to the inlet to allow air or similar gaseous substance to inflate the inflatable weighted tube 106. When activated, the air compressor 110 may pump the gaseous substance into the inflatable weighted tube 106 via the hose 108 through the inlet 112. The plug or stopper 114 may prevent the gaseous substant from escaping the inflatable weighted tube 106 through the inlet 112 once inflated.

In an embodiment of the present invention, the inflatable weighted tube 106 may be in gaseous communication with the air hose 108, and the hose 108 may be in gaseous communication with the air compressor 110. The air compressor 110 may be configured to convey compressed air into the inflatable weighted tube 106 through the hose 108 so as to inflate the inflatable weighted tube 106.

Referring to FIG. 2, a separated view of the cover securing system 100 where the pool cover 200 is shown above a pool 300 in accordance with the present invention. The pool 300 may be an above ground pool, a hot sub or spa, or other above ground, contained, body of water. The pool cover 200 may be positioned over a water surface 304 where the pool cover 200 may completely cover the water surface 304 and extend to a top rail 302 of the pool 300. The weigh down apparatus 104 may provide the weight and pressure to keep the pool cover 200 on the water surface 304 during use.

Referring to FIG. 3, a perspective of the cover securing system 100 atop the pool 300 is shown in accordance with the present invention The pool cover 200 may be positioned to completely cover the water surface and the top rail 302 of the pool 300. The peripheral edge 204 of the pool cover 200 may be secured against the top rail 302 with the peripheral fasteners 206. The may allow the pool cover 200 to be securely held tight against the water surface of the pool 300. The peripheral fasteners 206 may be a clip, clamp or other similar fastening means.

Referring to FIG. 4, a perspective view of the cover securing system 100 is shown during use. The cover securing system 100 anchors the pool cover 200 against the pool 300 so that when inclement weather happens the pool cover 200 does not blow away. Often, pool covers 200 will lift when wind gusts 400 traverse the pool 300. The cover securing system 100 may provide multiple anchoring means to ensure that the wind gusts 400 do not remove the pool cover 200, including the weigh down apparatus 104 and the peripheral fasteners 206. The combination of these devices ensure that the cover securing system 100 keeps the pool cover 200 in place on the pool 300 during all weather conditions.

The inflatable weighted tube 106 may be generally shaped so that the pair of tubular members 108 are positioned towards the top rail 302 (FIG. 3), and the U-shaped middle portion 112 bends towards the middle of the pool cover 200 at the pair of junctions 110. The substantially M-shape of the inflatable weighted tube 106 may allow for small or minimal amounts of air to pass beneath the pool cover 200 while positioned on the water surface of the above ground pool 300 during use. Depending on the size of the above ground pool 300 the pair of tubular members 108 and the U-shaped middle portion 112 may be sized or adjusted to accommodate securely fitting atop the water surface. The pair of tubular members 108 may be curved or straight depending on the shape of the pool, thereby complimenting the top rail 302 and preventing air from coming under the pool cover. For example, the tubular members 108 may be curved for use with an oval or circular pool. Alternatively, the tubular members 108 may be straight for use with a square or rectangular pool.

Use of the cover securing system may be done by first positioning the pool cover over the water surface of the pool. Next the weigh down apparatus may be positioned on the top surface of the pool cover to begin anchoring the pool cover. The hose may be attached to the inlet by removing the plug, whereby air may be pumped into the inflatable weighted tube from the compressor via the hose to further secure the pool cover atop the pool. Once the inflatable weighted tube is completely filled the hose may be removed and the plug replaced. Due to the unique shape of the weigh down apparatus, the tubular members allow the pool cover to maintain contact with the water surface and prevent lifting. The plurality of peripheral fasteners may then be positioned to secure the peripheral edge of the pool cover to the top rim of the pool. The weigh down apparatus may allow these fasteners to be attached much easier than simply attaching the pool cover alone because the pool cover is stabilized on the water surface. Finally the U-shaped middle portion may allow small amounts of air to pass beneath the pool cover, but it is insufficient to completely lift the cover from the pool. The cover securing system may be assembled and disassembled by a single user for ease of use and simplicity.

In an embodiment of the present invention, the cover securing system may comprise a peripheral fasteners and a weigh down apparatus.

In an embodiment of the present invention, the peripheral fasteners may be configured to engage a periphery of the pool cover with a top rail of the above-ground pool, such that the pool cover may be held tight to the above-ground pool.

In an embodiment of the present invention, the weigh down apparatus may be configured to be disposed on a surface of the pool cover which covers the above-ground pool, so as to weigh down the pool cover, thereby preventing the wind from blowing the pool cover off of the above-ground pool.

In an embodiment of the present invention, the peripheral fasteners may be a clip.

In an embodiment of the present invention, the clip may be configured to engage the periphery of the pool cover with the top rail of the above-ground pool.

In an embodiment of the present invention, the weigh down apparatus may comprise an inflatable weighted tube, an air hose and an air compressor.

In an embodiment of the present invention, the inflatable weighted tube may be in gaseous communication with the air hose.

In an embodiment of the present invention, the air hose may be in gaseous communication with the air compressor.

In an embodiment of the present invention, the air compressor may be configured to convey compressed air into the inflatable weighted tube through the air hose so as to inflate the inflatable weighted tube.

In an embodiment of the present invention, the inflatable weighted tube may be configured to be disposed on the surface of the pool cover.

The present invention is further directed to an above-ground pool construction.

In an embodiment of the present invention, the above-ground pool construction may comprise an above-ground pool, a pool cover and a cover securing system.

In an embodiment of the present invention, the cover securing system may comprise a peripheral fasteners and a weigh down apparatus.

In an embodiment of the present invention, the peripheral fasteners may engage a periphery of the pool cover with a top rail of the above-ground pool, such that the pool cover may be held tight to the above-ground pool.

In an embodiment of the present invention, the weigh down apparatus may be disposed on a surface of the pool cover which covers the above-ground pool, so as to weigh down the pool cover, thereby preventing the wind from blowing the pool cover off of the above-ground pool.

In an embodiment of the present invention, the peripheral fasteners may be a clip.

In an embodiment of the present invention, the clip may engage the periphery of the pool cover with the top rail of the above-ground pool.

In an embodiment of the present invention, the weigh down apparatus may comprise an inflatable weighted tube, an air hose and an air compressor.

In an embodiment of the present invention, the inflatable weighted tube may be in gaseous communication with the air hose.

In an embodiment of the present invention, the air hose may be in gaseous communication with the air compressor.

In an embodiment of the present invention, the air compressor may convey compressed air into the inflatable weighted tube through the air hose so as to inflate the inflatable weighted tube.

In an embodiment of the present invention, the inflatable weighted tube may be disposed on the surface of the pool cover.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A cover securing system for a pool cover on an above-ground pool comprising:

a plurality of peripheral fasteners, where the plurality of peripheral fasteners attach a peripheral edge of the pool cover to a rim of the above-ground pool;

a weigh down apparatus positioned atop a top surface of the pool cover, wherein the weigh down apparatus incudes:

an inflatable tube, where the inflatable tube is comprised of a pair of tubular members extending from a U-shaped middle portion to create an M-shape of the weigh inflatable tube; wherein the M-shape anchors the inflatable tube against the pool cover; and an inflation means removably coupled to the weigh down apparatus, where the inflation means inflates the weighted tube and further anchors the weigh down apparatus atop the pool cover.

2. The cover securing system of claim 1, wherein the weigh down apparatus includes a pair of junctions where the pair of tubular members meet the U-shaped center portion, where the pair of junctions further define the M-shape of the inflatable tube.

3. The cover securing system of claim 2, wherein the pair of junctions are rigid.

4. The cover securing system of claim 2, wherein the pair of junctions are flexible.

5. The cover securing system of claim 1, wherein the plurality of peripheral fasteners are clips.

6. The cover securing system of claim 1, wherein the plurality of peripheral fasteners are clamps.

7. The cover securing system of claim 1, wherein the inflatable tube is weighted.

8. The cover securing system of claim 1, wherein at least one of the tubular members includes an inlet, where the inlet allows the inflation means to inflate the weigh down apparatus.

9. The cover securing system of claim 8, wherein the inlet further includes a stopper to prevent deflation during use.

10. The cover securing system of claim 1, wherein the inflation means includes a hose and a compressor to facilitate inflating the weigh down apparatus with a gaseous substance.

11. The cover securing system of claim 10, wherein the gaseous substance is compressed air.

12. The cover securing system of claim 1, wherein the pool cover is made from a flexible, waterproof material.

13. The cover securing system of claim 12, wherein the flexible waterproof material is one of at least plastic, polyethylene, or canvas.

14. The cover securing system of claim 1, wherein the pair of tubular members are curved to compliment the rim of a circular above ground pool.

15. The cover securing system of claim 1, wherein the pair of tubular members are straight to compliment the rim of a rectangular above ground pool.

16. A method of use for a cover securing system to anchor a pool cover atop an above ground pool comprising the steps of:

positioning a pool cover over the above ground pool, where the pool cover rests atop a water surface of the above ground pool;

positioning a weigh down apparatus on a top surface of the pool cover, where the weigh down apparatus includes a weighted inflatable tube, where the weighted inflatable tube consists of a pair of tubular members extending from a U-shaped center portion;

inflating the weighted inflatable tube of the weigh down apparatus; and attaching a plurality of peripheral fasteners to a peripheral edge of the pool cover, where the plurality of peripheral fasteners couple the pool cover to the rim of the above ground pool.

17. The method of use for the cover securing system of claim 16, further comprising the step of attaching a hose to at least one of the tubular members, where the hose enables inflation of the weighted inflatable tube via a compressor.

18. The method of use for the cover securing system of claim 16, further comprising the step of removing a stopper from an inlet on one of the tubular members to inflate the weighted inflatable tube.

19. The method of use for the cover securing system of claim 15, further comprising the step of adjusting the pair of tubular members against the rim to prevent air from lifting the pool cover from the water surface.

20. A cover securing system for a pool cover of an above ground pool comprising:

a plurality of peripheral fasteners, where the plurality of peripheral fasteners attach a peripheral edge of the pool cover to a rim of the above-ground pool;

a weigh down apparatus positioned atop a top surface of the pool cover, wherein the weigh down apparatus incudes:

a weighted inflatable tube, where the weighted inflatable tube is comprised of a pair of tubular members extending from a middle portion to create a shape; wherein the shape anchors the weighted inflatable tube against the pool cover; and an inflation means removably coupled to the weigh down apparatus, where the inflation means inflates the weighted tube and further anchors the weigh down apparatus atop the pool cover.

* * * * *